US009072356B2

(12) United States Patent
Carey

(10) Patent No.: US 9,072,356 B2
(45) Date of Patent: Jul. 7, 2015

(54) HAIR CLIP

(71) Applicant: Bojana Carey, Elmhurst, IL (US)

(72) Inventor: Bojana Carey, Elmhurst, IL (US)

( * ) Notice: Subject to any disclaimer, the term of this patent is extended or adjusted under 35 U.S.C. 154(b) by 147 days.

(21) Appl. No.: 13/791,146

(22) Filed: Mar. 8, 2013

(65) Prior Publication Data

US 2013/0233337 A1 Sep. 12, 2013

Related U.S. Application Data

(60) Provisional application No. 61/609,346, filed on Mar. 11, 2012.

(51) Int. Cl.
*A45D 8/20* (2006.01)
*A45D 8/24* (2006.01)

(52) U.S. Cl.
CPC ... *A45D 8/24* (2013.01); *A45D 8/20* (2013.01)

(58) Field of Classification Search
CPC ..... A45D 8/20; A45D 8/14; A45D 2008/004
USPC ..... 132/273, 276–284, 53–55; 24/501, 509, 24/510, 511, 331, 332, 334, 338
See application file for complete search history.

(56) References Cited

U.S. PATENT DOCUMENTS

| | | | | |
|---|---|---|---|---|
| 1,864,199 | A * | 6/1932 | Kahn | 63/43 |
| 1,946,561 | A * | 2/1934 | Widerman | 132/277 |
| 2,849,008 | A * | 8/1958 | Otten | 132/277 |
| 3,025,581 | A * | 3/1962 | Duell | 24/563 |
| 5,758,672 | A * | 6/1998 | Chou | 132/275 |
| 6,408,859 | B1 * | 6/2002 | Shyu | 132/276 |
| 2004/0065341 | A1 * | 4/2004 | La Fauci | 132/277 |
| 2006/0021631 | A1 * | 2/2006 | Lafauci | 132/277 |
| 2007/0131239 | A1 * | 6/2007 | Harrison et al. | 132/277 |
| 2010/0012140 | A1 * | 1/2010 | Fitzpatrick | 132/200 |

* cited by examiner

*Primary Examiner* — Todd Manahan
*Assistant Examiner* — Brianne Kalach
(74) *Attorney, Agent, or Firm* — Andrew Alia, Esq.

(57) ABSTRACT

A hair clip for styling hair comprising a pair of clipping elements with two to three clipping fingers having toothed ridges and/or an overlay of rubbery material, with or without holes in the center of the clipping fingers, to facilitate gripping and holding hair strands and segments of hair on the head while blow drying wet or semi-wet hair to create volume and height to the resulting hair style without the use of mousse or gels. The hair clip is configured with an elastic connecting arrangement comprised of the thumb and forefinger grips of the clipping elements held together by a torsion spring or other compatible spring at the base of the hair clip.

14 Claims, 22 Drawing Sheets

HAIR CLIP

CROSS REFERENCE TO RELATED APPLICATION

This application claims priority under 35 USC 119(e) to U.S. Provisional Patent Application, Ser. No. 61/609,346 filed, Mar. 11, 2012, incorporated herein by reference in its entirety.

FIELD OF THE INVENTION

The present invention generally relates to hair accessories. More particularly, the invention relates to a versatile hair clip that can be used to hold segments of hair in place during hair styling.

BACKGROUND OF THE INVENTION

The use of hairclips to hold segments of hair together on different parts of the head as a means to groom and decorate the hair has been popular with young girls and women for centuries. Hair clips used for such purposes come in a variety of shapes, sizes, structural configurations and colors, many with ornamental appendages.

The use of non-decorative hairclips to hold particular sections of hair in place while cutting and styling hair is also well known in the art. These types of hairclips used by hairdressers and stylists are specifically constructed to accomplish the purpose of holding hair in place on different locations on the head while the hair is being cut or blow dried. Drying segments of wet hair rather than using the blow dryer on the entire head of hair, in particular, results in creating volume to the hair and height to the style, giving the appearance of thickness and fullness to the hair, an end result desired by many women and to a certain extent men.

The cost of hair grooming as with other personal care services and commodities has seen a significant increase in the last decade, prompting consumers to seek various means to do their own hair grooming and styling in the privacy of their homes, to save the expense of having to pay the hairdresser or stylist. Grooming one's hair at home to achieve the same fullness and bouffant effect created by a hair stylist requires having at hand the right hairclips and other accessories used routinely by the stylists to achieve those effects in the hair salon. Hair clips of the kind used by hair stylists to groom hair are well known in the art, but not readily available to the consumer for purchase from the super market or drug store.

The long felt need for hair styling hair clips that can be purchased by the consumer to enable them to style their hair at home on their own to achieve the same results as created by a hair stylist in a hair salon, has prompted the need to have these implements readily available for purchase in a supermarket, drug store, or online through the world wide web. The current invention of a hair styling, hair clip overcomes the deficiency in the prior art for hair clips that can be effectively used by women and men to style their hair on their own in the privacy of their homes to achieve the same results of volume, thickness and height to the hair as created by a stylist in a hair salon.

The hair clip of the present invention is structurally and functionally different from some of the hair styling hair clips in the prior art such as those described in U.S. Pat. No. 6,622,734, U.S. Pat. No. 6,591,843 and U.S. Pat. No. 6,408,859.

SUMMARY OF THE INVENTION

The present invention is a hair clip capable of holding segments of hair in place on various areas of the head while styling the hair to achieve the desired volume, fullness and height to the hair style without the use of gels and mousses popularly used to fluff up the hair to create the desired height and depth to the hair style. The hair clip of the present invention is intended for purchase by the consumer as well as the hair salon stylist from a super market, drug or other store either directly or available for purchase online from these stores or from virtual stores.

The exemplary embodiment of the hair clip of the present invention is comprised of a pair of clipping elements connected to each other at their base by means of an elastic connecting arrangement. In this embodiment of the invention, each clipping element is comprised of a plurality of contoured clipping fingers with a pair of thumb and forefinger grips. A pair of protrusions on the inside surface of the thumb/forefinger grips have orifices for the insertion of a pin and an insertion recess area between the protrusions. In this embodiment, the insertion recess of one clipping element receives and mates with the insertion recess of the other clipping element with a torsion spring or similar spring held between the recesses as they come together so that the orifices on the set of protrusions of each clipping element line up with the orifices of the protrusions on the other clipping element and the torsion or other similar spring for the insertion of a pin to hold the two clipping elements together to create the elastic connecting member.

In the preferred exemplary embodiment of the hair clip of the present invention, there are two sets of clipping elements each having three elongated and contoured clipping fingers with two of the fingers having reinforcement ribs to make them stronger.

In yet another embodiment of the hair clip of the present invention, each clipping element is comprised of two clipping fingers with the clipping elements held at their base through the same elastic connecting arrangement as with the hair clip with three clipping fingers on each clipping element.

In the exemplary embodiments of the hair clip of the present invention, the clipping fingers of the clipping elements are lined with a plurality of toothed ridges and/or bumps separated by a plurality of depressions on their inside surfaces. In this embodiment, the plurality of toothed ridges of one clipping finger mate with a plurality of depressions on the opposing clipping finger. This allows for the insertion of strands of hair between the toothed ridges to enable the clipping fingers to grip the hair uniformly and hold the segment of hair securely in place on the head. In other embodiments, the clipping finger surfaces may be flat with no toothed ridges or depressions and may have an over molding rubbery material to grip hair more effectively.

In the exemplary embodiments of the hair clip of the present invention, the tips of the clipping fingers are chamfered to allow easier insertion of the clipping fingers into the hair.

In the preferred exemplary embodiments of the hair clip of the present invention, the clipping fingers are contoured with a concave shaped outer surface and a flat inner surface. The set of clipping fingers on the two ends of the hair clip have openings at their center to allow for air from the hair dryer to enter the hair and dry the hair while it is being styled. In this embodiment, the set of clipping fingers at the center of the hair clip are devoid of holes. However, hair clips with the two outside clipping fingers without any holes are also envisioned within the scope of the invention.

In the preferred embodiment of the present invention, the clipping elements of the hairclip is constructed from a plastic material. However, it will be understood and obvious to those skilled in the art that other materials may be used to construct the clipping elements.

In this summary of the invention and in the specification in general, the various references to "the exemplary embodiment" "preferred exemplary embodiment" "yet another embodiment" or "preferred embodiment" do not necessarily refer to the same embodiment (s). Rather, these references to the various embodiments in general mean that a particular feature, structure, or characteristic described in conjunction with an embodiment is included in at least some embodiments, but not necessarily all embodiments of the invention. The objects, features and advantages of the hair clip of the present invention through its various embodiments as described in this summary of the invention will be further appreciated and will become obvious to one skilled in the art when viewed in conjunction with the accompanying drawings, detailed description of the invention, and the appended claims.

DETAILED DESCRIPTION OF THE INVENTION

The present invention is a hair clip specifically constructed for ease of use in styling hair by a novice consumer on their own in the privacy of their home to create bouffant hair styles just like the ones created by a stylist in a hair salon. The embodiments of the invention hold segments of hair securely in place to allow blow drying the wet and/or semi-wet hair held in place by the hair clip and the strands beneath it, to create volume and height to the hair once the styling is completed. Thus the primary aim of the hair clip of the present invention is to transform flat, lifeless hair to wildly full hair, thereby boosting the hair to new extremes and novel styles.

Figure 1:
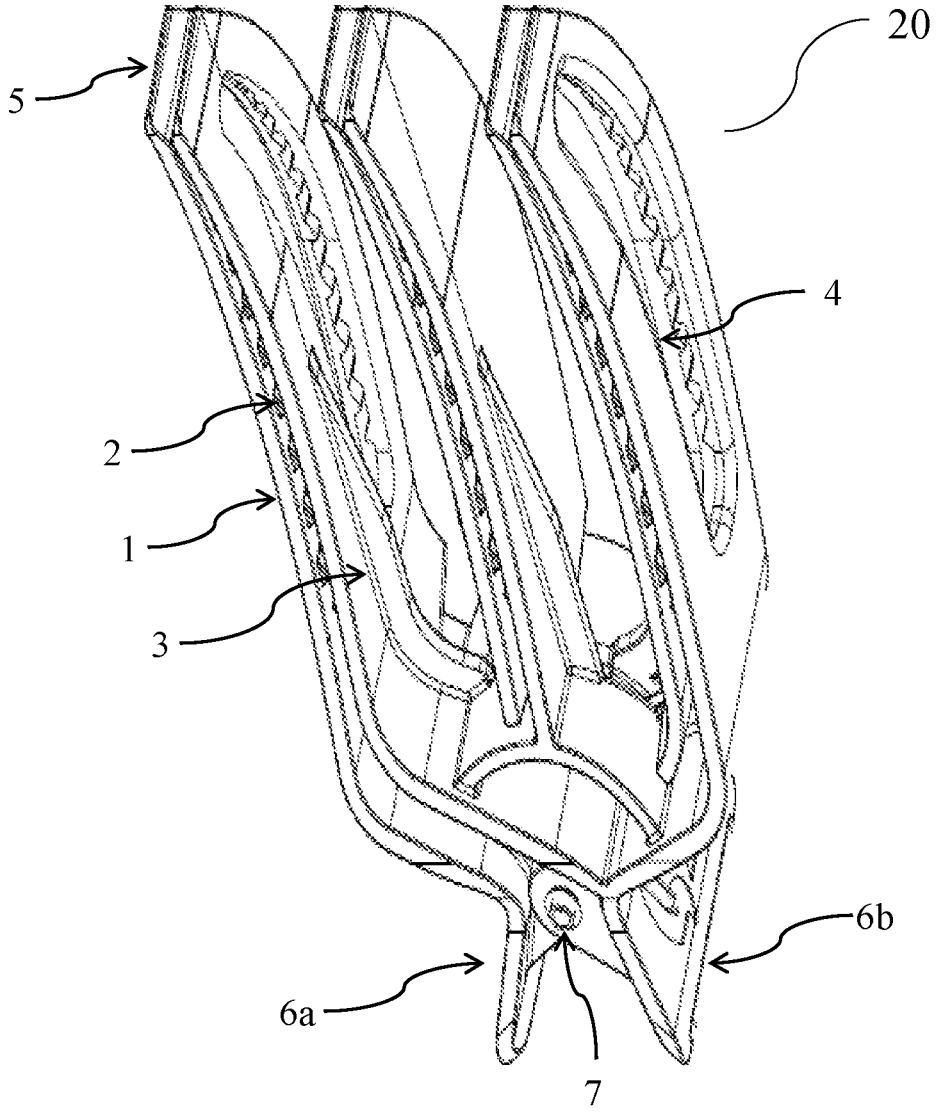
FIG. 1 is a perspective view of the exemplary embodiment of the hair clip of the present invention.

Referring now to the drawings, more particularly to FIG. 1 a perspective view of an exemplary embodiment of the hair clip 20 of the present invention is shown in a closed configuration. In this embodiment, there are three clipping fingers 1 and they are in a closed configuration. The toothed ridges 2 can be seen through the closed clipping fingers 1. In this exemplary embodiment of the hair clip, the toothed ridges 2 help hold the strands of hair between the clipping fingers 1. Further, in this perspective view of the hair clip 20, the reinforcement rib 3 can be seen on two of the clipping fingers 1. The function of the reinforcement rib 3 is to provide strength to the clipping fingers of the hair clip 20.

In the exemplary embodiment of the hair clip 20 of the present invention as shown in FIG. 1, a hole 4 can be seen on the two outside sets of clipping fingers 1 while the center clipping finger is devoid of a hole. The holes 4 enable air to enter and filter through the hair strands held in place by the clipping fingers 1 while the hair is being blow dried using a hair dryer. Another feature of the clipping fingers 1 of the hair clip 20 is the chamfered tips 5 which facilitate easy insertion of the clipping fingers 1 into the hair without poking the scalp as would happen with hair clips having clipping fingers with pointed ends. In this and other embodiments of the hair clip 20 the shape of the hair clip 20 is ergonomically designed to follow the head shape and can be inserted in the hair from any direction.

Other features shown in FIG. 1 of the perspective view of the exemplary embodiment of the hair clip 20 are the thumb and forefinger grips 6*a* and 6*b* and the elastic connecting arrangement 7. The thumb and forefinger grips 6*a* and 6*b* when squeezed together opens the clipping fingers 1 apart for insertion into the hair strands. The elastic connecting arrangement 7 provides flexibility in gripping and squeezing to open the clipping fingers 1 and releasing the thumb and forefinger grips 6*a* and 6*b* once the clipping fingers 1 are inserted between the hair strands or segments of hair to hold the hair securely in place on the head to facilitate blow drying and styling the hair.

Figure 2:
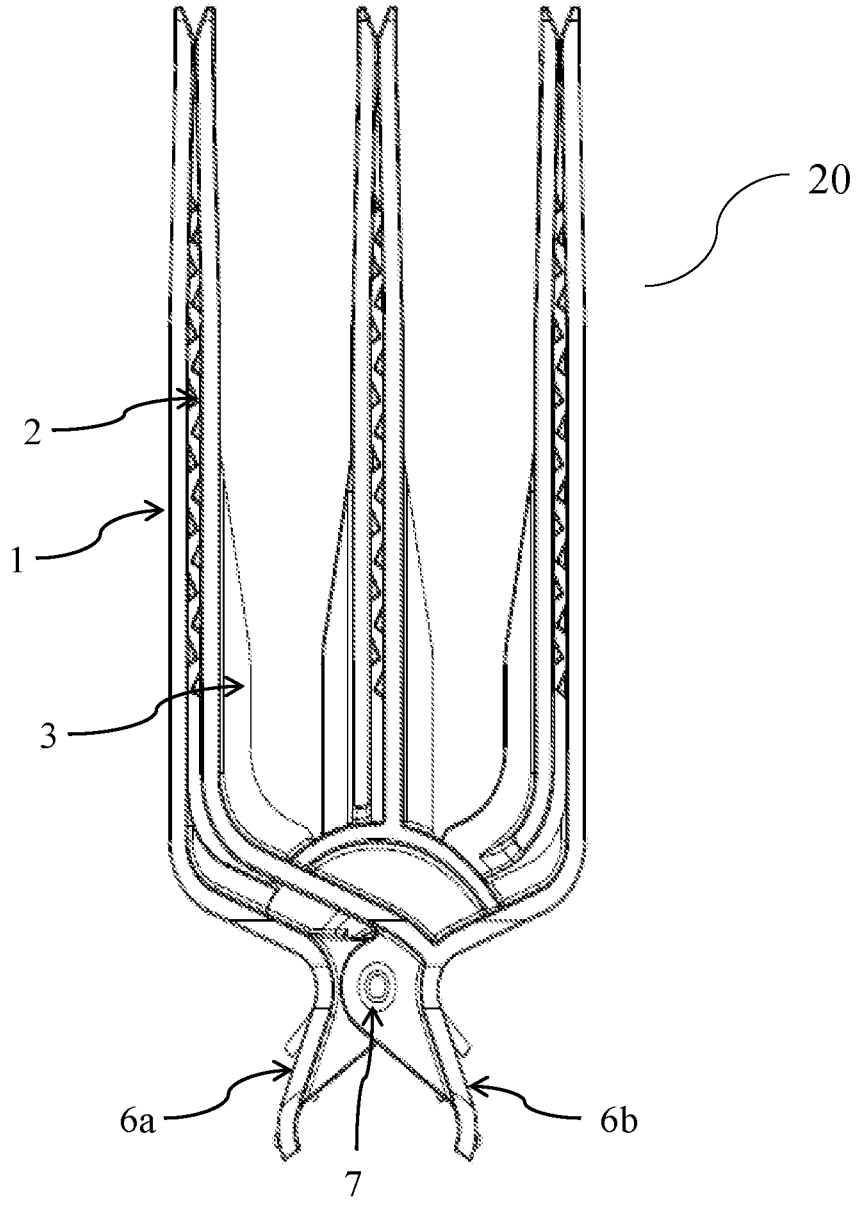
FIG. 2 is a side view of the exemplary embodiment of the present invention in a closed configuration.

Referring now to FIG. 2, a perspective view from the side of the hair clip 20 is shown. In this perspective view, the hairclip 20 is in the closed configuration with the toothed ridges 2 of each clipping finger 1 aligned and touching the depressed area of the opposite clipping finger 1. This view provides a clearer illustration of the positioning of the reinforcement ribs 3. The view also shows the alignment of the clipping fingers 1 relative to one another and the chamfered tips 5. This side perspective view of hair clip 20 also shows the elastic connecting arrangement 7 and the two thumb and forefinger grips 6*a* and 6*b* on one side of the hair clip 20, the side seen in this perspective view of the hair clip 20.

Figure 3:
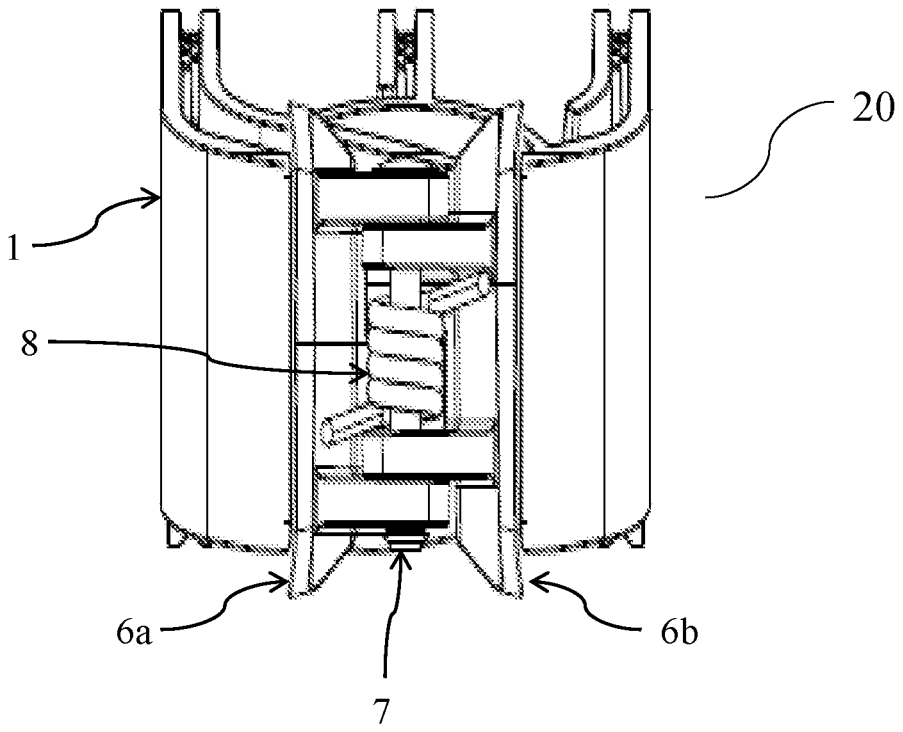
FIG. 3 is a perspective view of the bottom end of the hair clip of the present invention.

FIG. 3 is a perspective view of the bottom of the hair clip 20 of the present invention. This view shows the bottom end of the clipping fingers 1, the thumb grips 6*a* and 6*b* and the elastic connecting arrangement 7. In addition, this view also shows the torsion spring 8 held in place in the recess area of the elastic arrangement 7 between the thumb and forefinger grips 6*a* and 6*b*.

Figure 4:
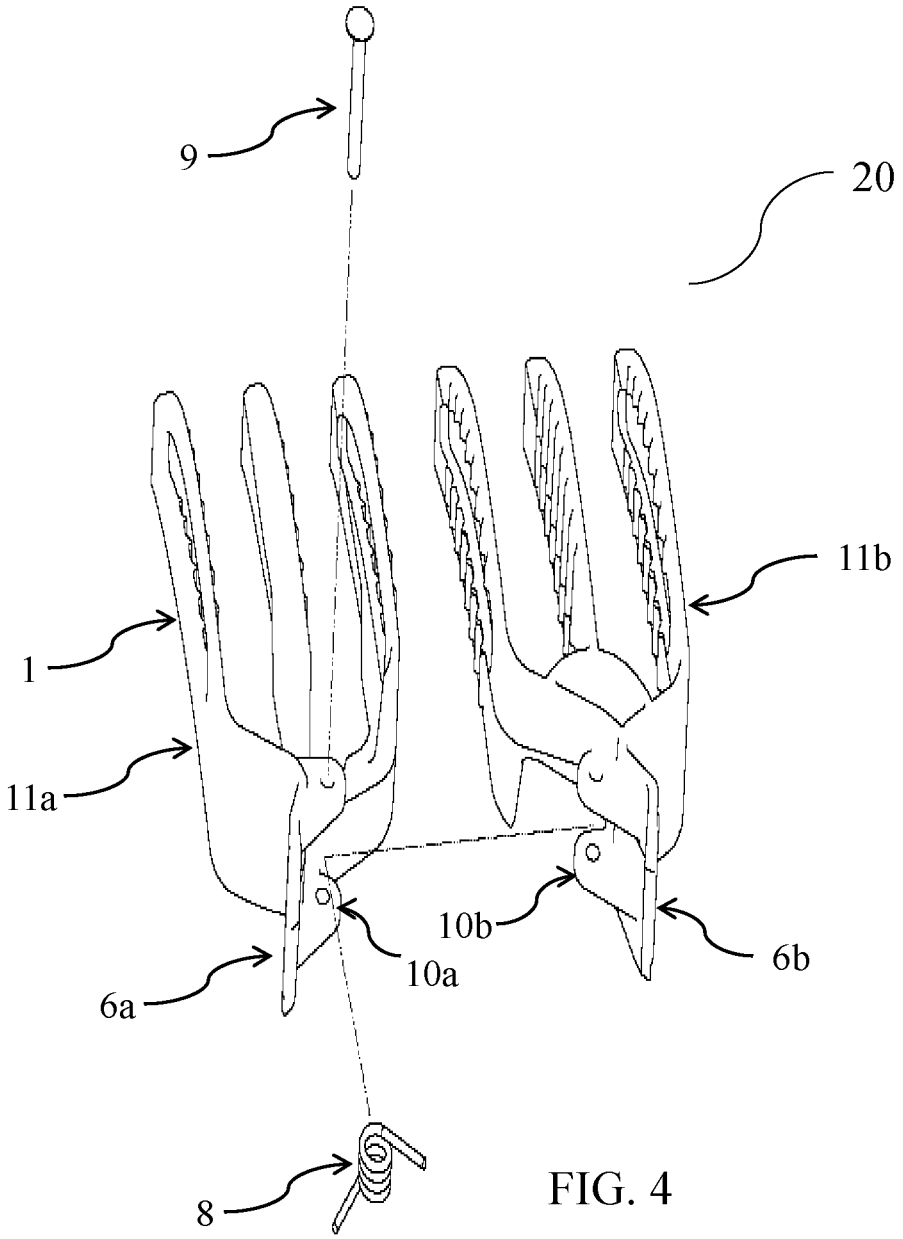
FIG. 4 is an exploded view showing the two clipping elements, the torsion spring and the pin used to insert through the orifices on the protrusions of the thumb and forefinger grips to create the elastic connecting arrangement.

FIG. 4 is an exploded view of the hair clip 20 showing the clipping elements 11*a* and 11*b* separated from each other. In this view, the protrusions 10*a* and 10*b* on the insides of the thumb grips can be seen with their orifices and recessed areas. In the exemplary embodiment of the hair clip 20 of the present invention, the protrusions 10*a* and 10*b* of the clipping elements 11*a* and 11*b* are brought together to mate with each other through their recessed areas. In this configuration, the orifices on the protrusions 10*a* and 10*b* align to create a single orifice for the insertion of the pin 9. A torsion spring 8 is disposed in the common recessed area created between the protrusions of the two clipping elements 11*a* and 11*b* when they mate with each other and aligns its hole with the holes in the protrusions 10*a* and 10*b* so that the pin can go through all the holes to hold the two clipping elements 11*a* and 11*b* securely at their base.

Figure 5:
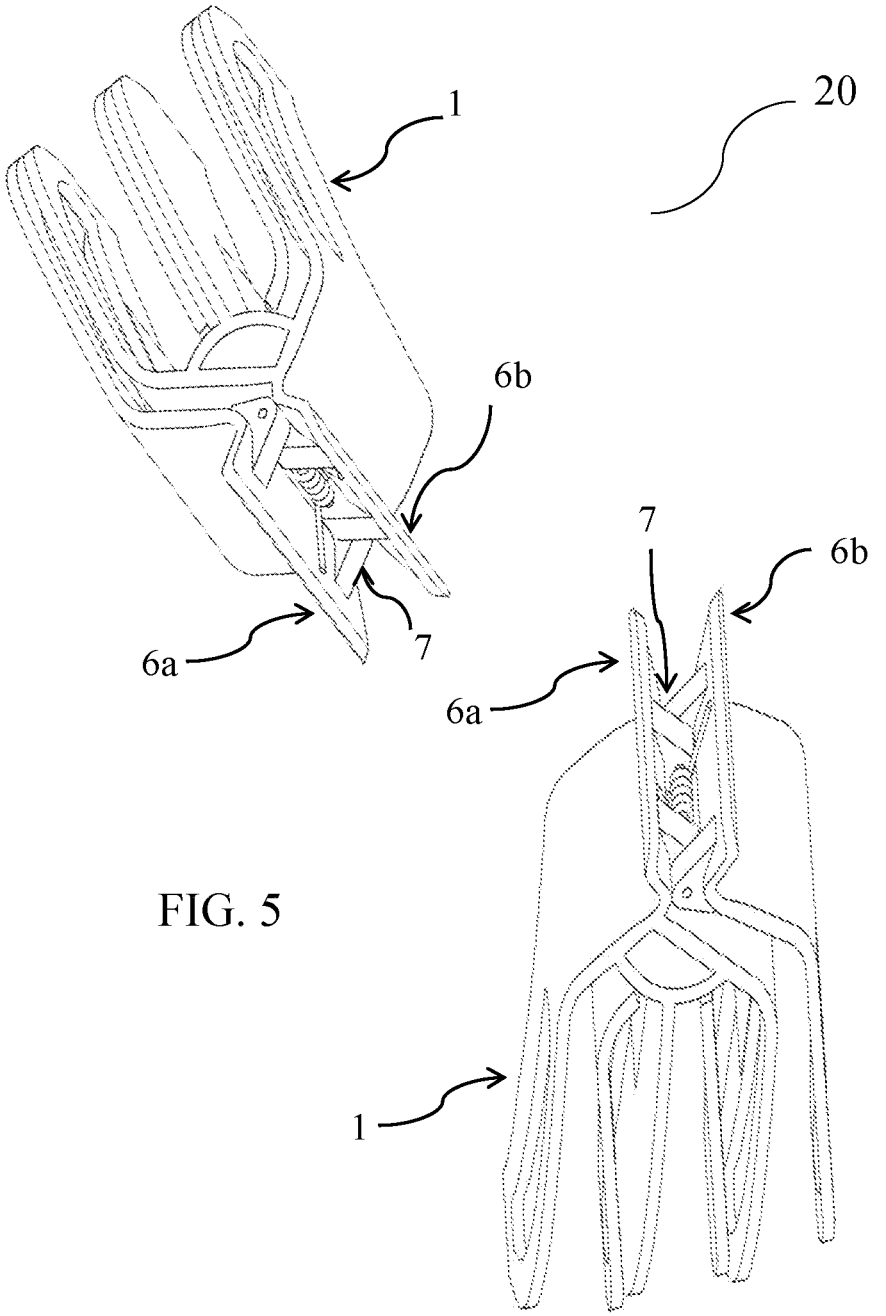
FIG. 5 shows two perspective views of an embodiment of the hair clip of the present invention without toothed ridges on the clipping fingers.

FIG. 5 shows two perspective views of the hair clip 20 of the present invention, the top first view with the clipping fingers in a closed configuration when the thumb and forefinger grips 6*a* and 6*b* are not operated and the bottom second view with the clipping fingers in the open position when the thumb and forefinger grips 6*a* and 6*b* are squeezed together.

Figure 6:
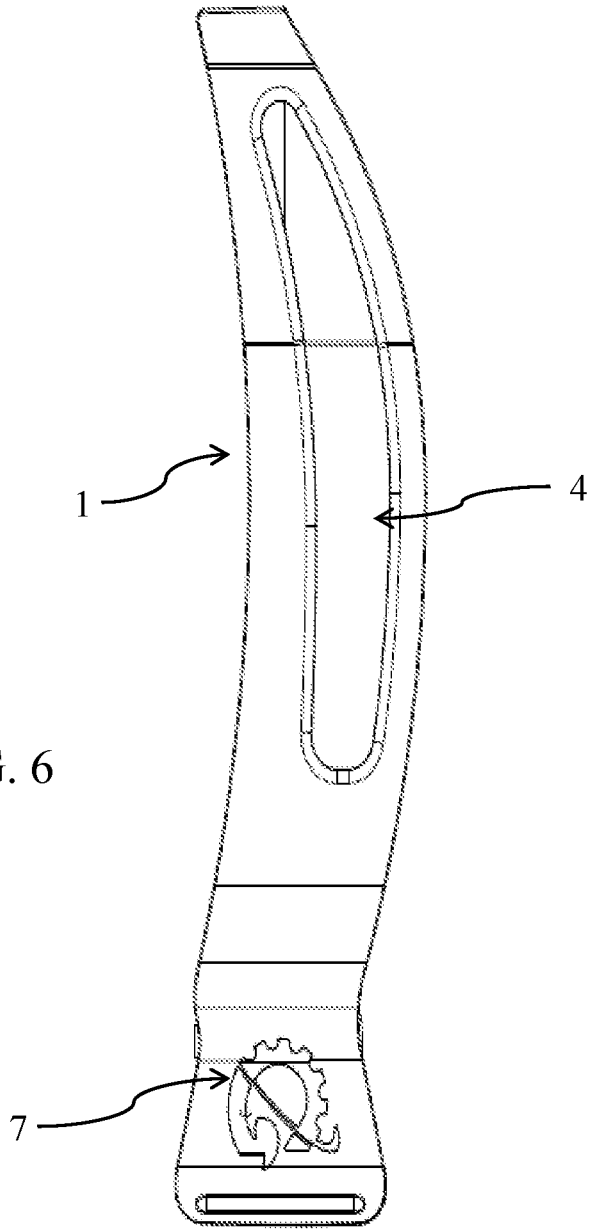
FIG. 6 is a side view of a clipping finger of the hair clip of the present invention.

FIG. 6 shows a side view of a clipping finger 1 facing the outside of the hairclip 20 showing the concave shape of the clipping finger 1 and the hole 4 in the center following the length of the clipping finger 1. The view also illustrates the elastic connecting member 7 at the base of the clipping finger 1. The hole 4 in the center of the clipping finger 1 allows for the flow of air from the hair dryer to blow dry the hair to create volume and height to the style.

Figure 7:
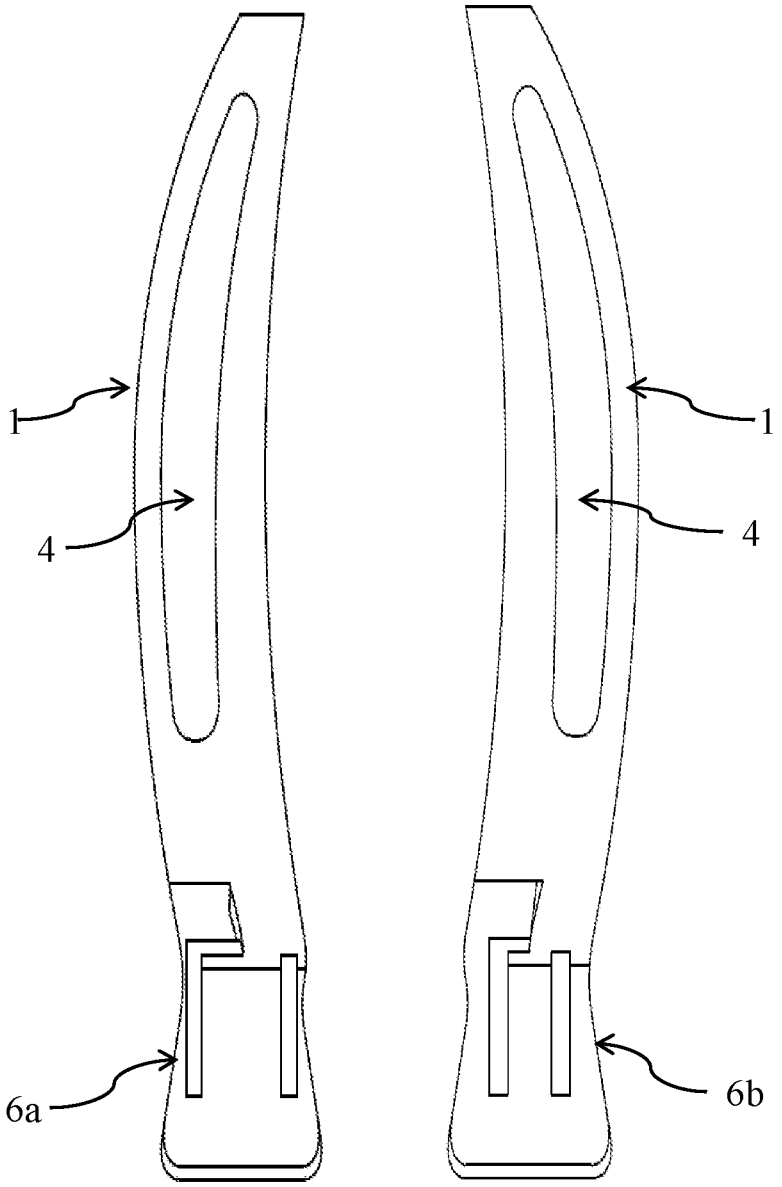
FIG. 7 are two other side views of the clipping fingers.

FIG. 7 shows two perspective views of the clipping finger 1 with holes 4 and cross sections of the thumb and forefinger grips 6*a* and 6*b*.

Figure 8:
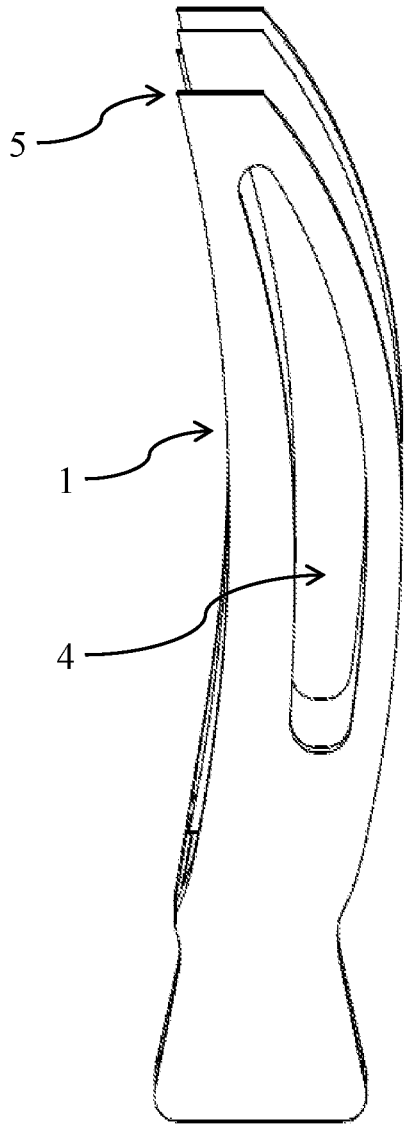
FIG. 8 is a side view of a clipping element with the clipping fingers.

FIG. 8 is a side perspective view of a clipping element 11 with three clipping fingers 1, and the hole 4 in the outside clipping finger. This view also illustrates the chamfered tops 5 of the clipping fingers 1.

Figure 9:
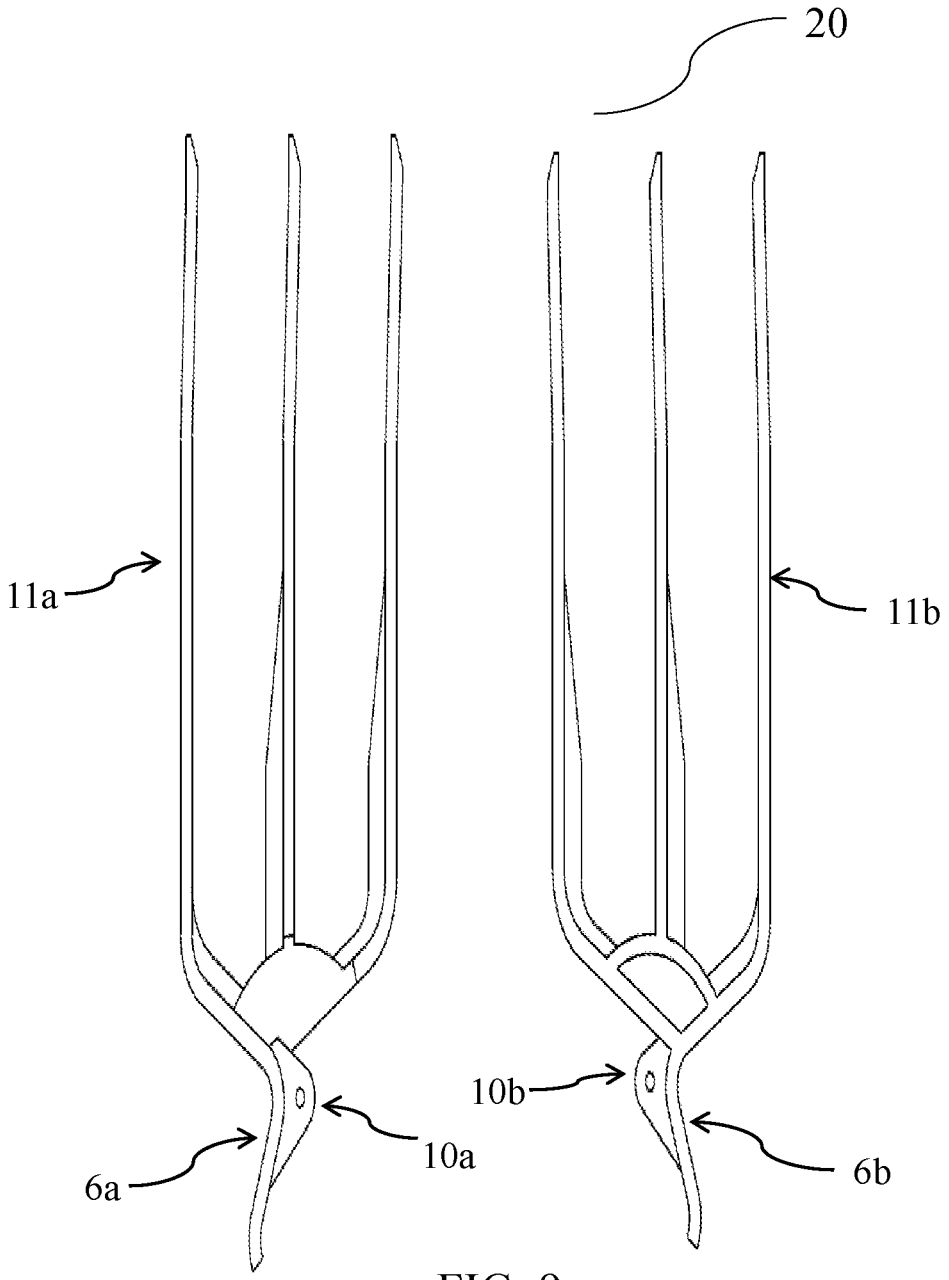
FIG. 9 is an exploded perspective view of two clipping elements.

FIG. 9 shows an exploded view of the hair clip 20 with the clipping fingers 11*a* and 11*b* separated. The other features seen in this view are the thumb and forefinger grips 6*a* and 6*b* and the protrusions 10*a* and 10*b*.

Figure 10:
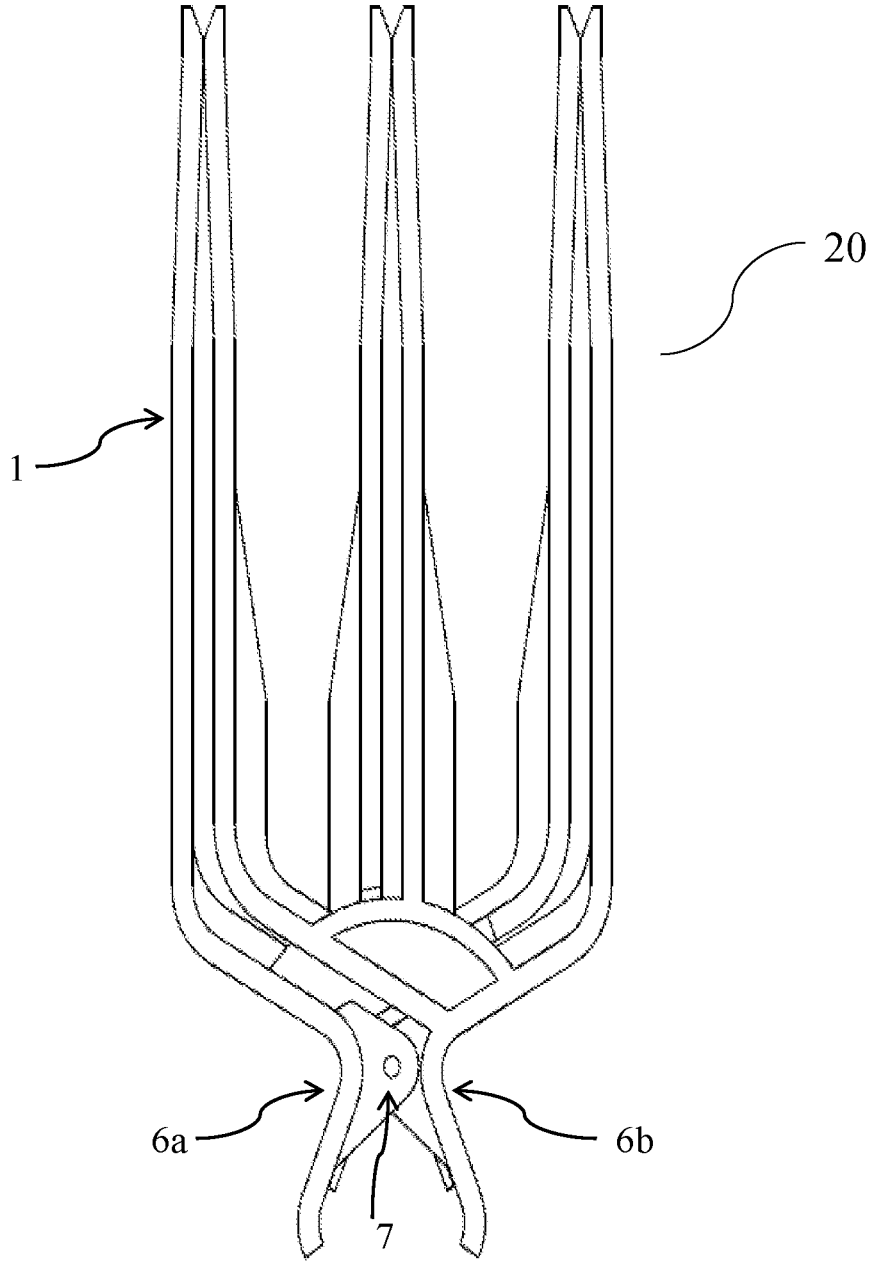
FIG. 10 is a side view of the hairclip without the toothed ridges in a closed configuration.

FIG. 10 is a perspective view from the side of another embodiment of hair clip 20 without the toothed ridges. In some embodiments, the clipping fingers have an over laying of a rubbery material to grip the hair more effectively. In this view, the clipping fingers 1 are in the closed configuration touching and lying parallel to each other. The reinforcement ribs 3, the chamfered tips 5, the thumb and forefinger grips 6*a* and 6*b*, and the elastic connecting arrangement 7 are also illustrated in this view of the hair clip 20.

Figure 11:
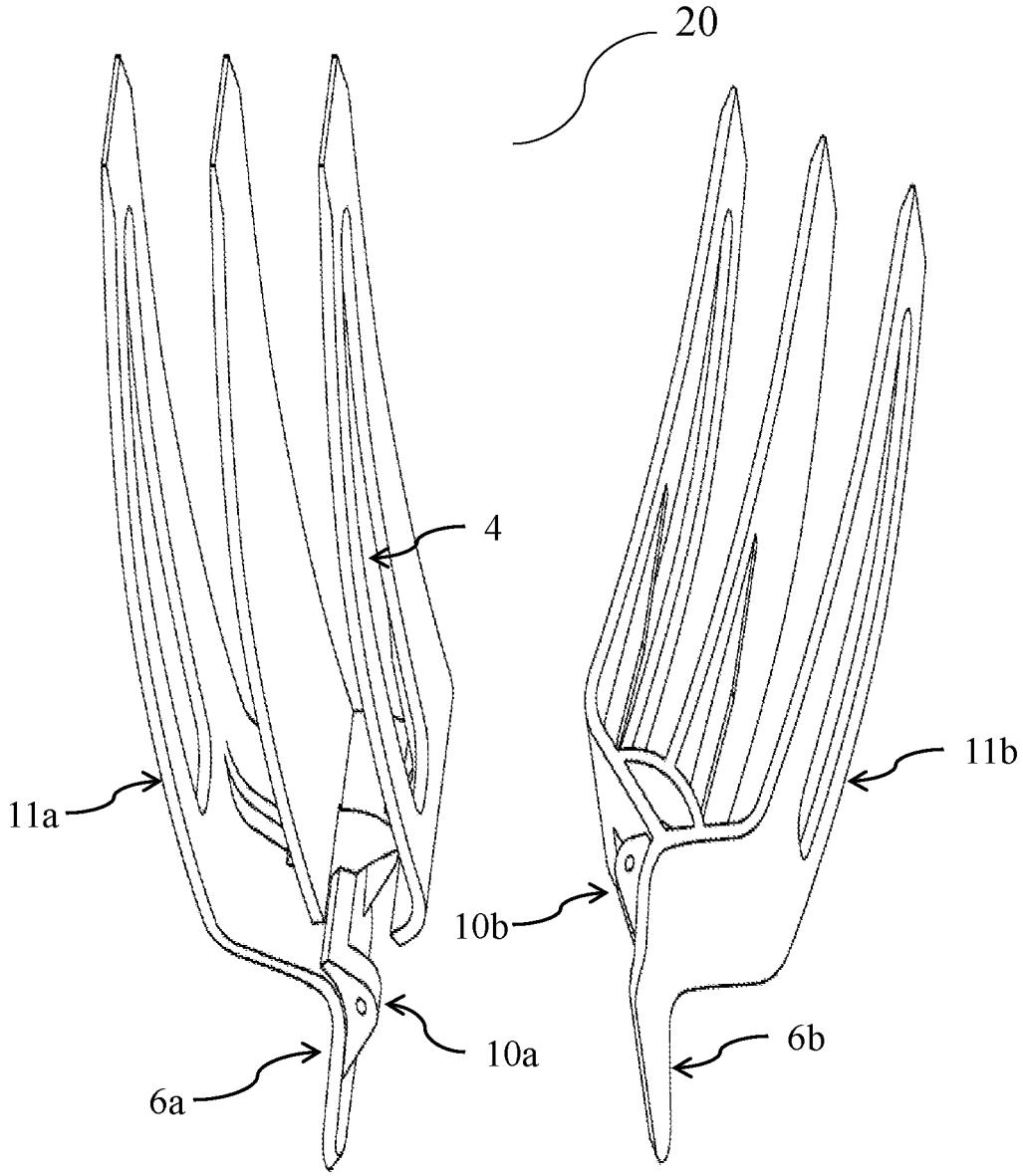
FIG. 11 is an exploded view of the two clipping elements in a separated configuration.

FIG. 11 shows an exploded view of the hair clip 20 with the two clipping elements 11*a* and 11*b* separated. The clipping element 11*a* is seen with two of the clipping fingers with the holes 4 and the middle clipping finger without the hole.

Figure 12:
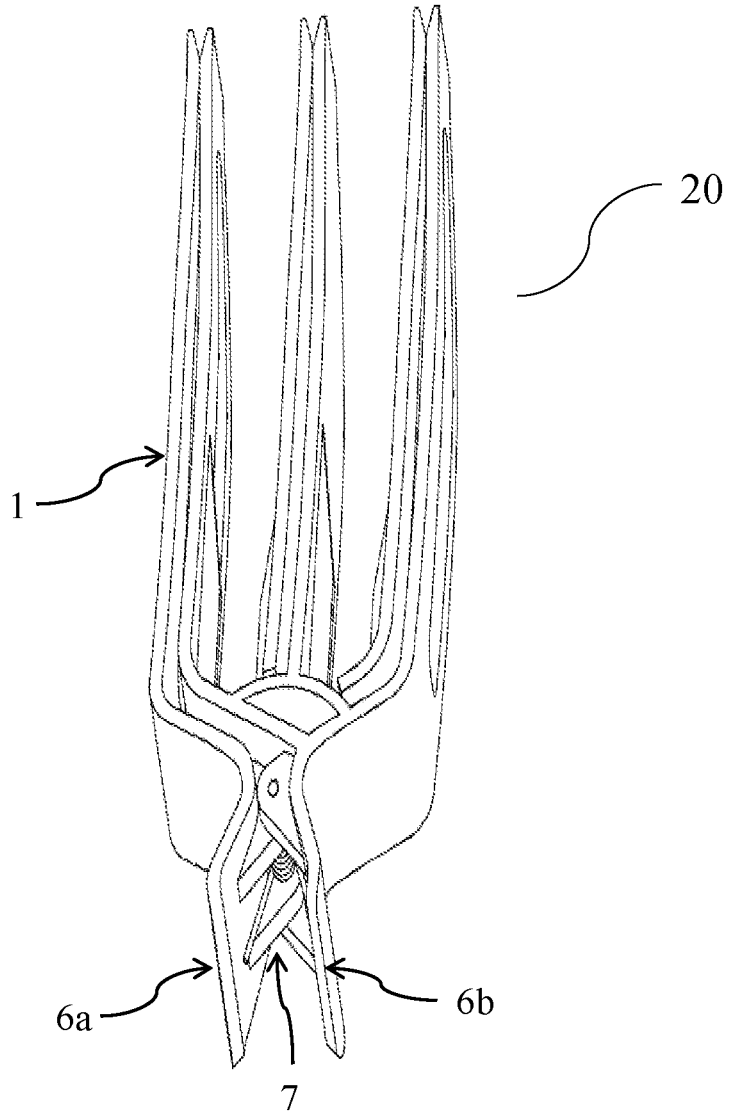
FIG. 12 is another perspective view of the hair clip in a closed configuration.

FIG. 12 shows another perspective view of the hair clip 20 with the clipping fingers 1 in a closed configuration.

Figure 13:
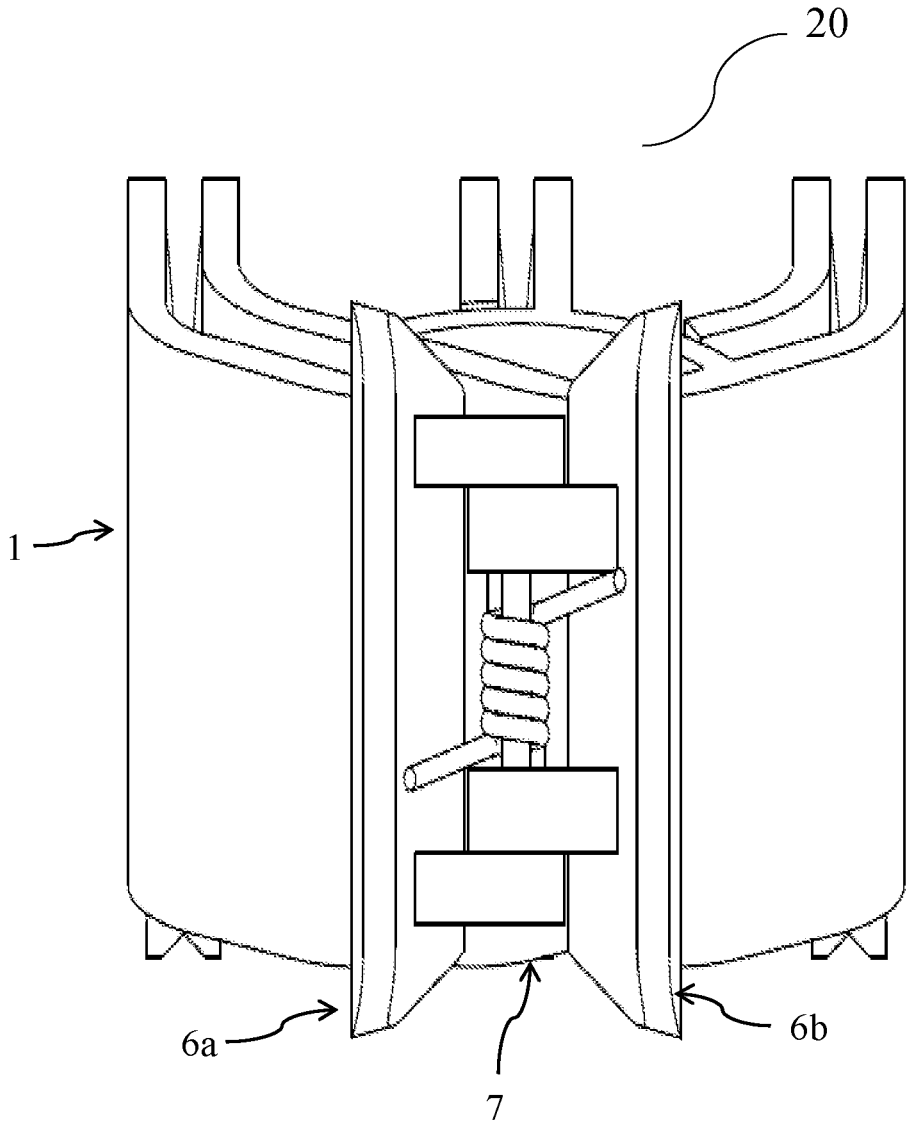
FIG. 13 is a perspective view of the bottom end of the hair clip without the toothed ridges in a closed configuration.

FIG. 13 shows another perspective view of the bottom of an embodiment of the hair clip 20 without the toothed ridges between the clipping fingers 1. In this embodiment, the hair clip 20 is in a closed configuration.

Figure 14:
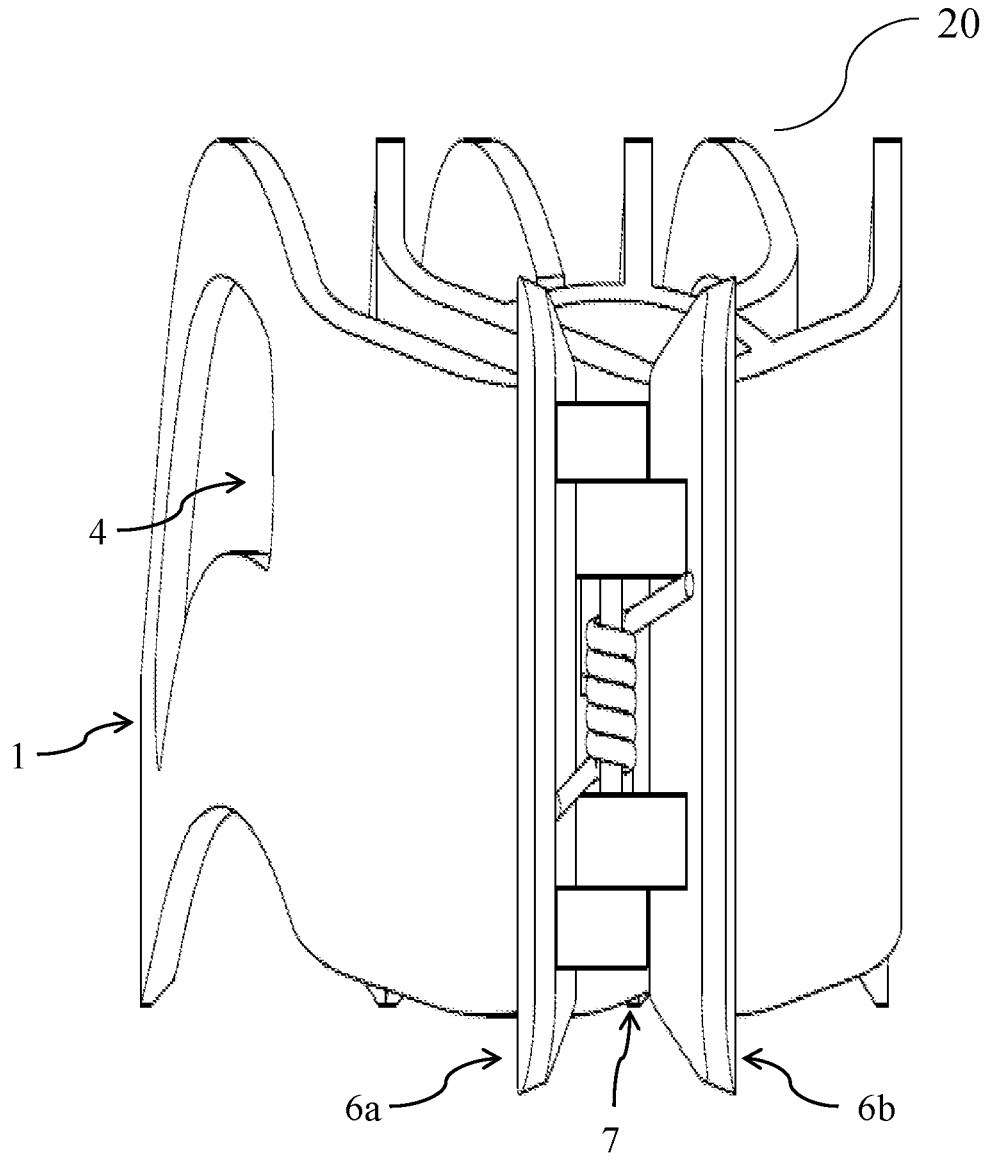
FIG. 14 is a perspective side view of the bottom end of the hairclip in an open configuration.

FIG. 14 shows a side perspective view of the bottom end of the hair clip 20 with a view of the hole 4 in one of the outside clipping fingers 1. In this embodiment, the hair clip 20 is in an open configuration.

Figure 15:
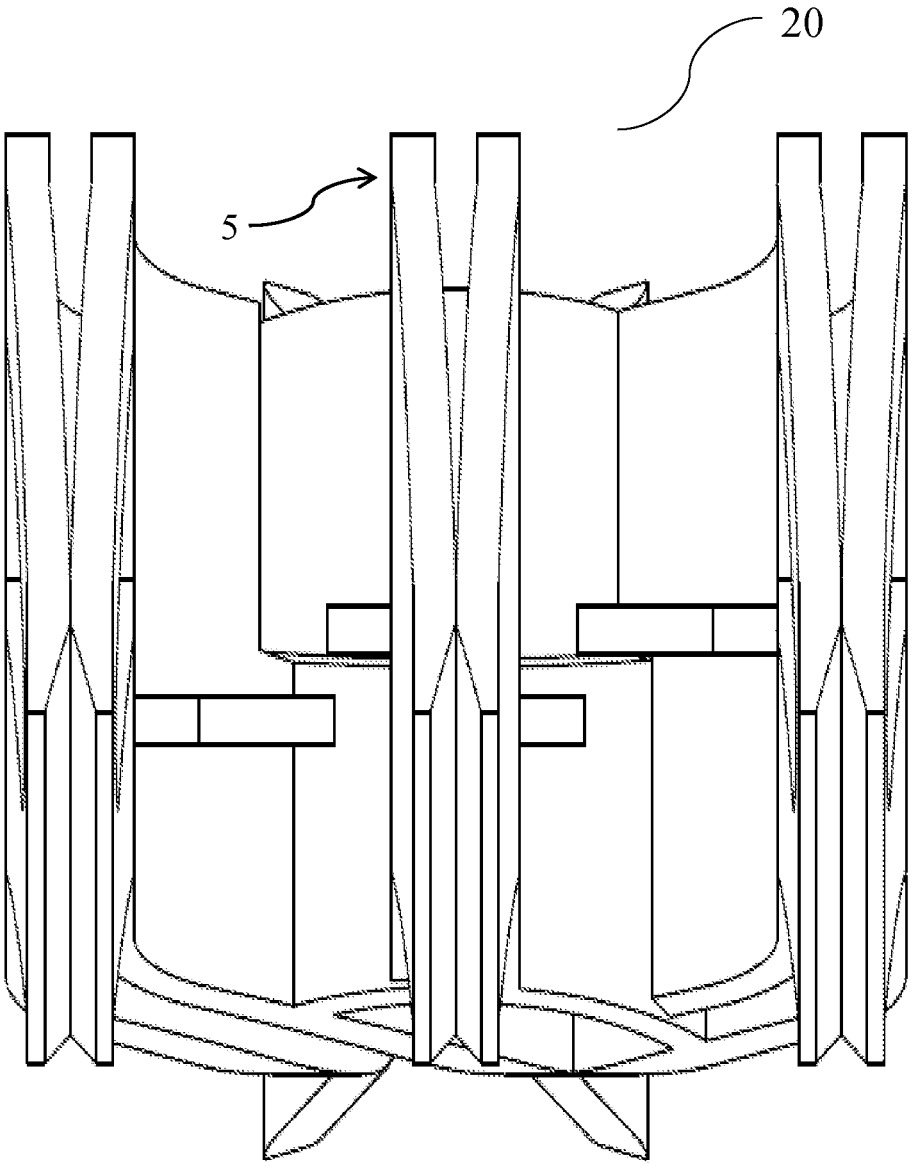
FIG. 15 is a top plan view of the hair clip showing the chamfered tip ends of the clipping fingers.

FIG. 15 is a top plan view of the chamfered tips 5 of the clipping fingers 1 of the hair clip 20.

Figure 16:
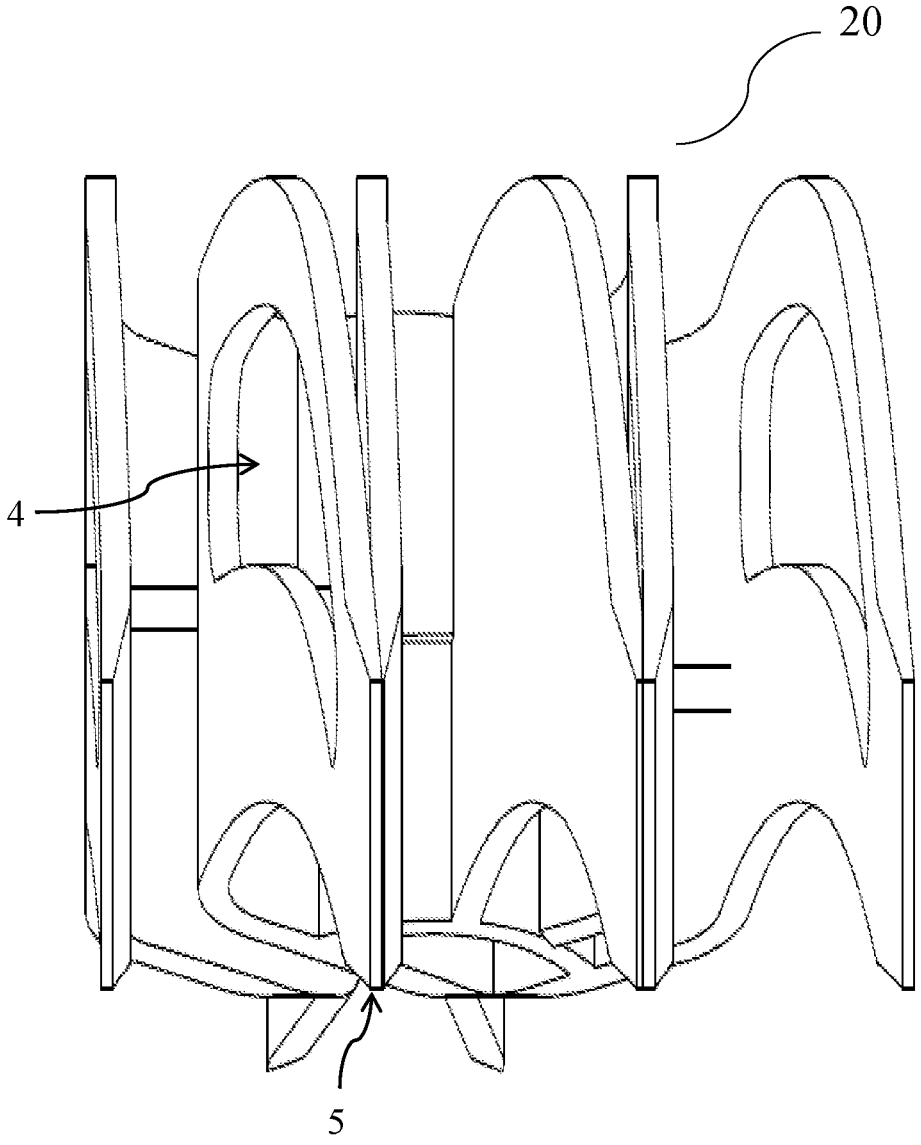
FIG. 16 is a top plan view of the hairclip in an open configuration showing the holes in the clipping fingers and the chamfered tip ends.

FIG. 16 is a top plan view of the hairclip 20 in an open configuration showing the holes 4 in the clipping fingers and the chamfered tip ends 5.

Figure 17:
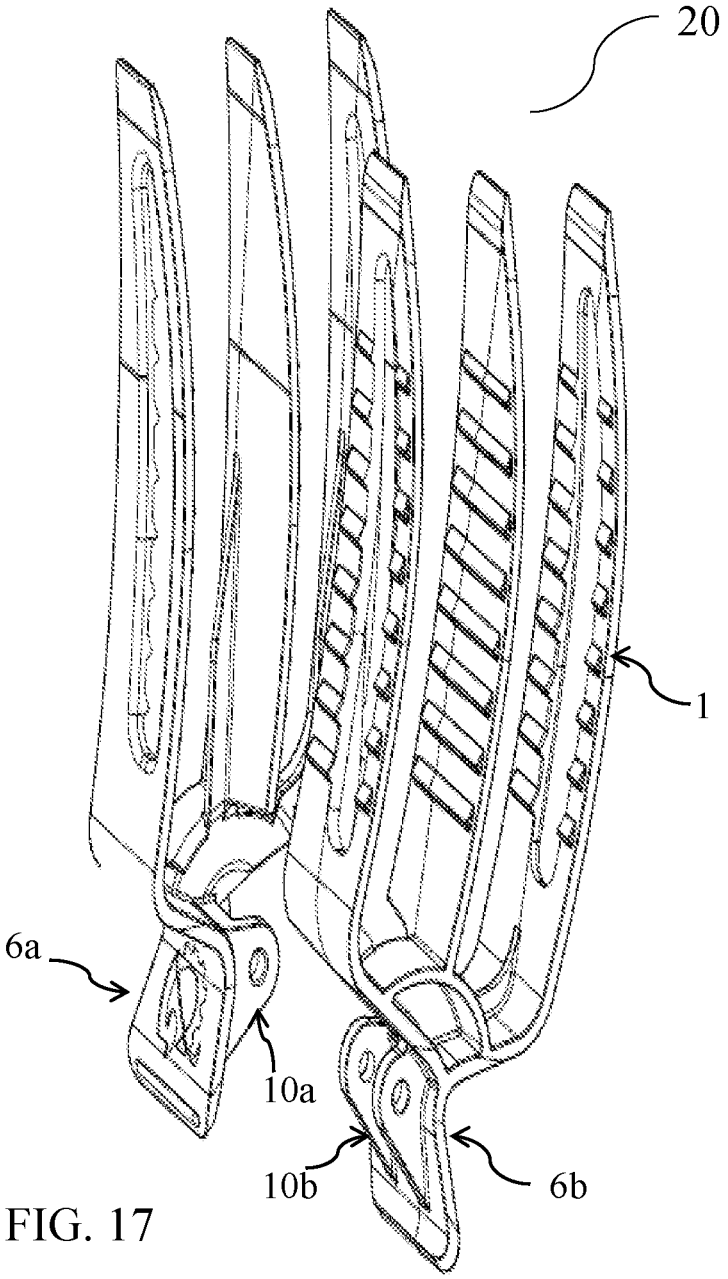
FIG. 17 is an exploded view of another embodiment of the hairclip of the present invention.

FIG. 17 is an exploded view of another embodiment of the hair clip 20 showing the separated clipping elements 11*a* and 11*b* with illustrations of the thumb and forefinger grips 6*a* and 6*b* and the protrusions 10*a* and 10*b*.

Figure 18:
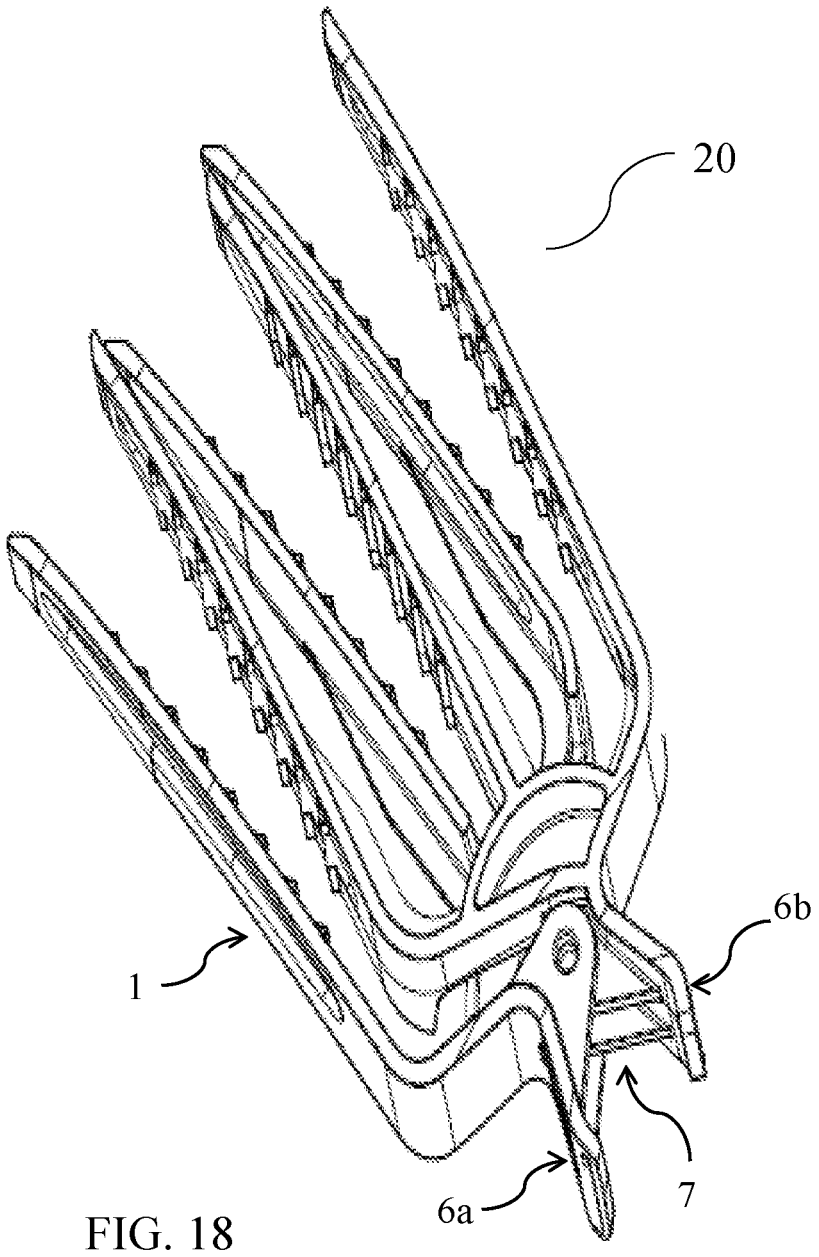
FIG. 18 is a perspective view of another embodiment of the hair clip in an open configuration.
Figure 19:
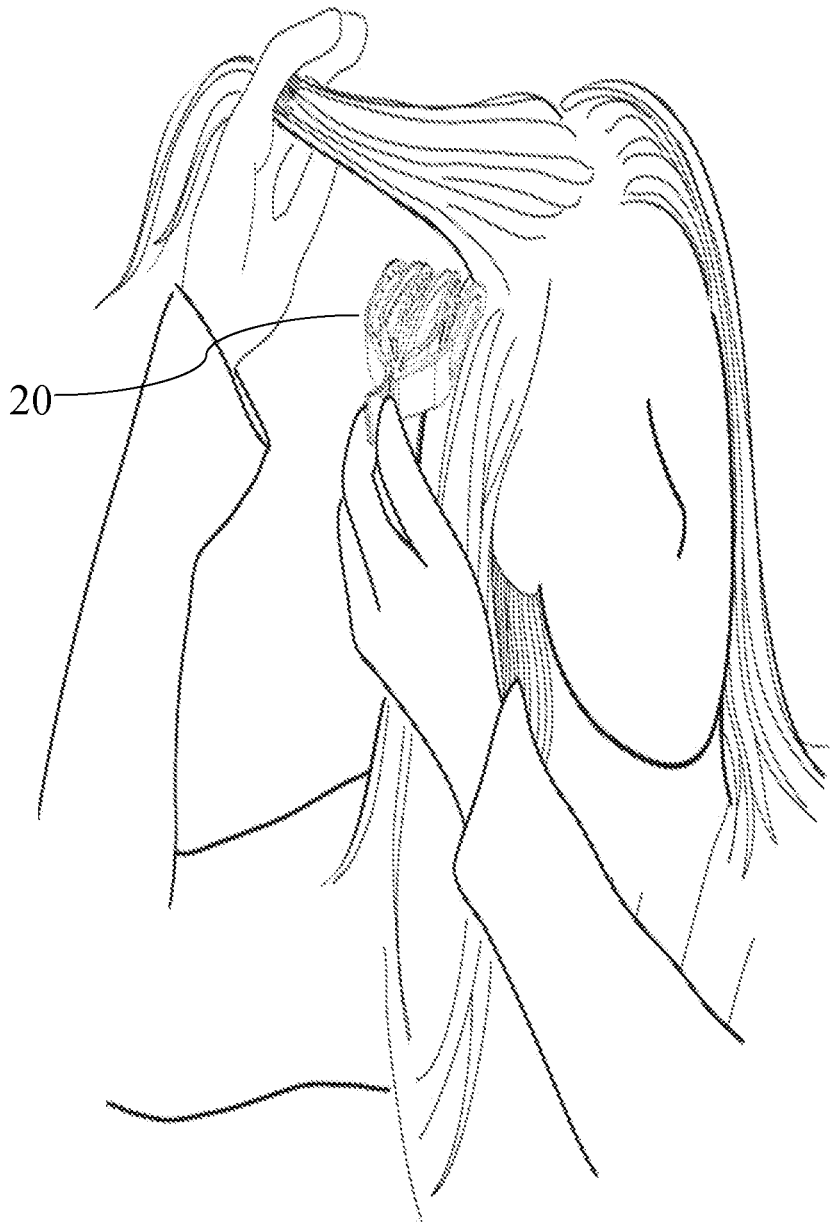
FIG. 19 is a perspective view of the use of the hair clip.
Figure 20:
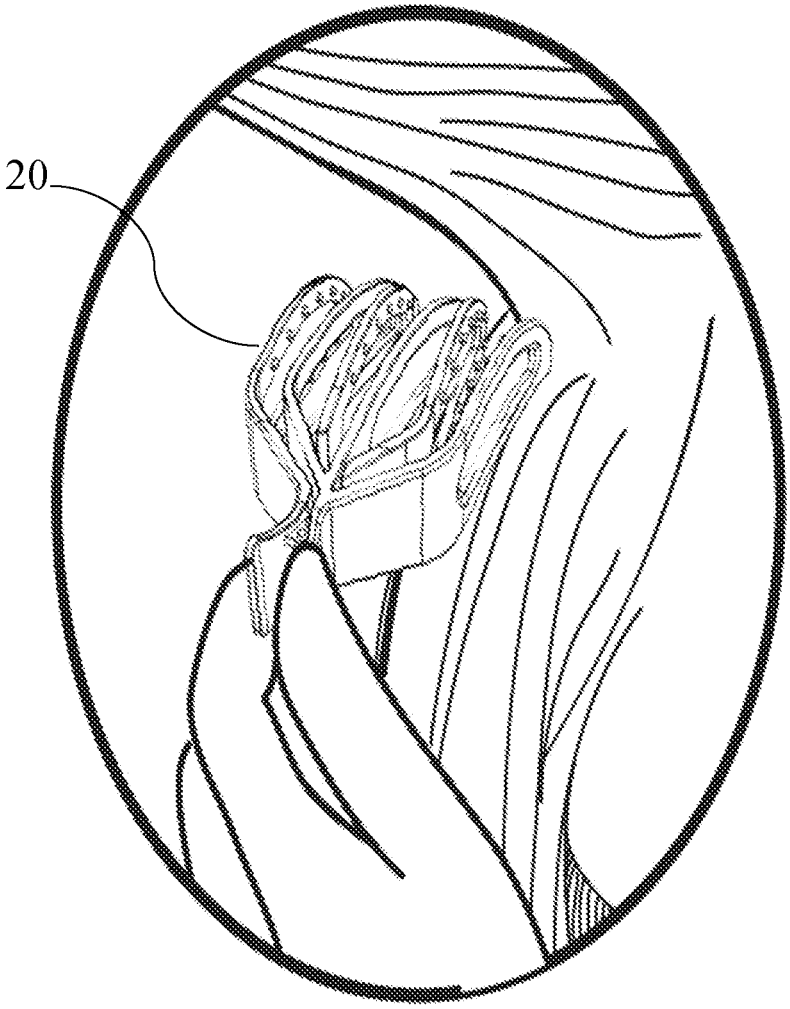
FIG. 20 is a close up perspective view of the use of the hair clip.
Figure 21:
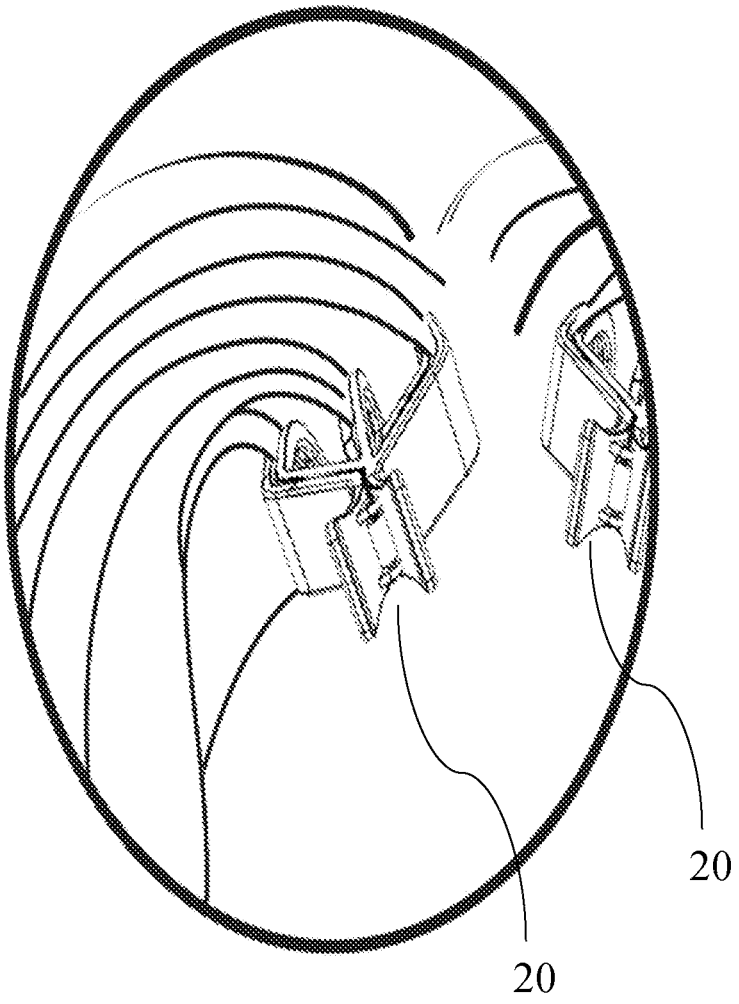
FIG. 21 is a close up view of the operation of the hair clip.
Figure 22:
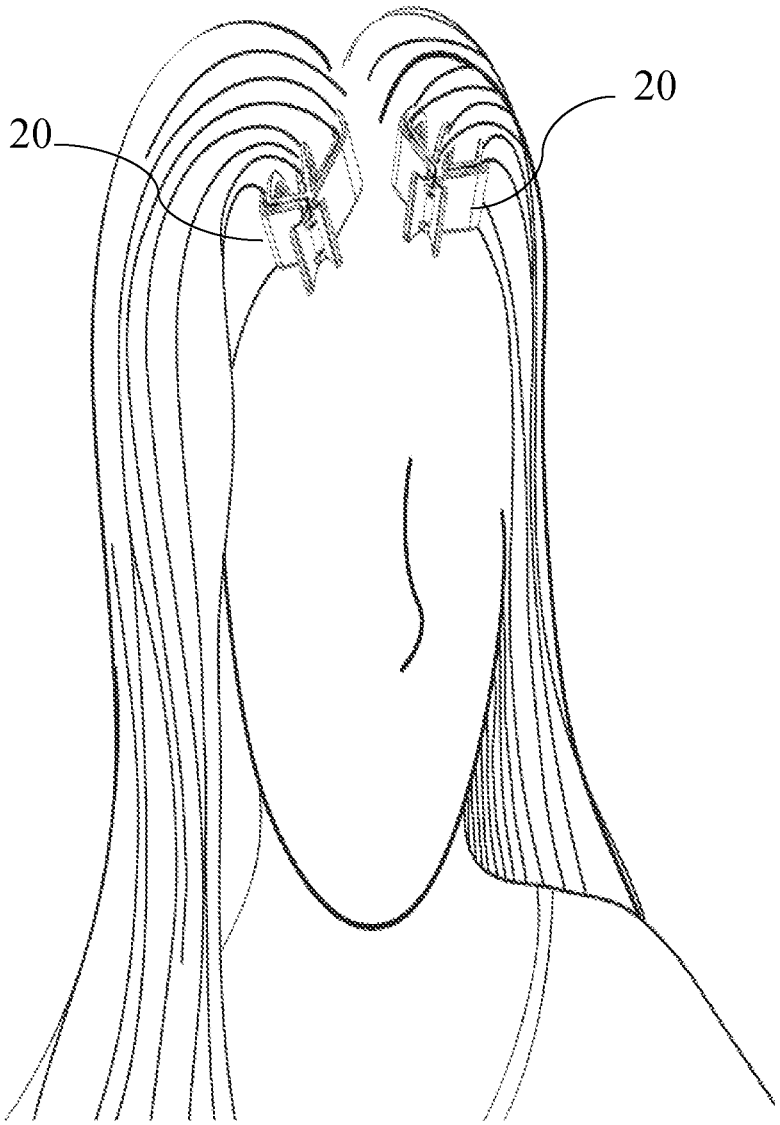
FIG. 22 is a perspective view of another use of the hair clip.

FIG. 18 is a perspective view of the assembled embodiment of the hair clip 20 shown in the exploded view in FIG. 17. In this perspective view, the clipping fingers 1 are shown in an open configuration brought about by squeezing the thumb and forefinger grips 6*a* and 6*b*.

FIG. 19-22 are illustrations showing the use of the hair clip 20 in separating the hair strands and holding them in place on the head to allow styling of the hair to create volume and height to the styles.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions. Although various features of the invention may be described in the context of a single embodiment, the features may also be provided separately or in any suitable combination. Conversely, although the invention may be described herein in the context of separate embodiments for clarity, the invention may also be implemented in a single embodiment. Furthermore, it is to be understood that the invention can be carried out or practiced in various ways and that the invention can be implemented in embodiments other than the ones outlined in the description above.

While the invention has been thus described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A hair clip for styling hair in three parallel sections, said hair clip comprising:

a first clipping element member including at least three spaced apart clipping fingers, a second clipping element member including at least three spaced apart clipping fingers, wherein the first and the second clipping element are configured to fix hair between each of three parallel pairs of clipping fingers, each pair comprising a clipping finger from the first and the second clipping element;

each clipping finger having a plurality of toothed ridges and a plurality of depressions, the toothed ridges of each clipping finger aligned with and touching the depressions of an opposing clipping finger, the clipping fingers configured such that the hair to be styled may be held firmly between the clipping finger and the opposing clipping finger;

said first and said second clipping element members characterized by a thumb and forefinger grip member and the clipping element members configured perpendicular to the user's scalp;

said thumb and forefinger grip member characterized by a set of protrusion members with orifices and recess areas disposed between adjacent orifices;

said set of protrusion members of the said thumb and forefinger grip member of said first clipping members and the set of protrusion members of said thumb and forefinger grip member of said second clipping element member mating with each other through the said recess area;

a spring member disposed between said protrusion members; and a pin member defining a hinge axis, disposed through the orifices of the said protrusion members and said spring member to hingedly connect said first and the said second clipping element members, said clipping fingers spaced transversely to the hinge axis.

2. The hair clip as in claim 1 wherein the first clipping element member and the second clipping element member when hingedly connected through their thumb and forefinger grip members create an elastic connecting arrangement at a base of the hair clip to provide flexibility in gripping and squeezing to open the clipping fingers and when releasing the thumb and forefinger grips once the clipping fingers are emplaced to enclose hair strands or segments of hair to hold the hair securely in place in three parallel sections to facilitate blow drying and styling the hair.

3. The hair clip as in claim 1 wherein said at least three clipping fingers of said first and second clipping element are molded together at respective base ends.

4. The hair clip as in claim 1 wherein each of said clipping fingers has a base and a chamfered tip, the chamfered tip being narrower than the base.

5. The hair clip as in claim 1 wherein each said clipping finger is contoured with a concave shaped outer surface and a flat inner surface.

6. The hair clip as in claim 5 wherein the plurality of toothed ridges and the plurality of depressions are disposed on the flat inner surface of the clipping fingers such that the hair is held by the toothed ridges on the flat inner surfaces.

7. The hair clip as in claim 1 wherein two of said clipping fingers have reinforcement ribs extending perpendicular to the clipping fingers to provide strength to the hair clip.

8. The hair clip as in claim 1 wherein two outermost clipping fingers have holes to allow air from a hair dryer to penetrate the hair held by the clipping fingers to dry the hair and to create volume to the hair.

9. The hair clip of claim 1 wherein the spring member comprises a torsion spring to hingedly connect the first and the second clipping element members.

10. The hair clip of claim 1 wherein each of the clipping fingers comprise a centerhole.

11. The hair clip as in claim 1 wherein the hair clip is constructed from a plastic material.

12. The hair clip of claim 1 wherein the plurality of clipping fingers comprise an over laying of an elastic material.

13. The hair clip of claim 1, wherein the first clipping element member comprises a cutout on a lower left side for joining the first and the second clipping element members by overlaying the first clipping element member onto the second clipping element member to create three parallel pairs of clipping fingers, each pair comprising a clipping finger from the first and the second clipping element.

14. A hair clip for styling hair in three parallel sections said hair clip comprising:

a first clipping element member including at least three spaced apart clipping fingers, each of said clipping finger having a flat inner surface;

a second clipping element member including at least three spaced apart clipping fingers;

each said clipping finger having a flat inner surface;

each said first and said second clipping element members further having a thumb and forefinger grip member able to align the grip member and the clipping element members perpendicular to the user's scalp, each of said thumb and forefinger grip member having a set of protrusion members with orifices and recess areas between adjacent said orifices;

a spring member disposed against said first thumb and forefinger grip member and against said second thumb and forefinger grip member;

a pin member defining a hinge axis, extending through the orifices of the said protrusion members to hingedly connect said first second clipping element member with said second clipping element member; said clipping fingers spaced transversely to the hinge axis, and, wherein the first clipping element member comprises a cutout on a lower left side for joining the first and the second clipping element members by overlaying the first clipping element member onto the second clipping element member to create three parallel pairs of clipping fingers, each pair comprising a clipping finger from the first and the second clipping element.

* * * * *